US006409067B1

(12) United States Patent
Huret

(10) Patent No.: US 6,409,067 B1
(45) Date of Patent: Jun. 25, 2002

(54) STEP-BY-STEP RECOVERY OF A STRIP

(76) Inventor: Vincent Huret, Domaine de Montgarny, Route de Terny, 02880 Margival (FR)

( * ) Notice: Subject to any disclaimer, the term of this patent is extended or adjusted under 35 U.S.C. 154(b) by 0 days.

(21) Appl. No.: 09/581,014

(22) PCT Filed: Jul. 10, 1999

(86) PCT No.: PCT/FR99/02398

§ 371 (c)(1),
(2), (4) Date: Sep. 1, 2000

(87) PCT Pub. No.: WO00/20313

PCT Pub. Date: Apr. 13, 2000

(30) Foreign Application Priority Data

Oct. 7, 1998 (FR) ..... 98 12546
May 12, 1999 (FR) ..... 99 06073

(51) Int. Cl.[7] ..... B65H 20/00; B65B 3/04

(52) U.S. Cl. ..... 226/160; 226/148; 226/156; 53/235; 156/584

(58) Field of Search ..... 226/142, 148, 226/156, 157, 160, 118.4; 156/584

(56) References Cited

U.S. PATENT DOCUMENTS 4,089,451 A * 5/1978 Zlaikha ..... 226/156 X
4,638,991 A * 1/1987 Kato ..... 226/142 X
4,768,915 A * 9/1988 Fujioka ..... 226/62 X
4,887,778 A 12/1989 Soth et al.
5,013,291 A 5/1991 Granger
5,147,279 A 9/1992 Granger
5,725,140 A * 3/1998 Weber et al. ..... 226/139
5,975,395 A * 11/1999 Takada et al. ..... 226/148 X

FOREIGN PATENT DOCUMENTS

EP 0 345 061 * 6/1989
EP 0 340 124 * 11/1989

* cited by examiner

*Primary Examiner*—Michael R. Mansen
(74) *Attorney, Agent, or Firm*—Duane Morris LLP

(57) ABSTRACT

A device for picking up a strip of film, in particular for removing a support film from a robot for automatically placing electronic components, wherein the film is grasped either between two wheels rotating in opposite directions, the wheel entraining the wheel in one direction and then running over the film in the opposite direction, or else between the fixed jaw and the moving jaw of a clamp hinged about a pin, the moving jaw being moved towards the fixed jaw by coming into contact with a part of the machine which then moves the clamp as a whole together with the film.

3 Claims, 3 Drawing Sheets

STEP-BY-STEP RECOVERY OF A STRIP

The present invention relates to a device for moving. a film or strip of plastics material intended particularly, but not exclusively, for recovering step by step films that are unrolled from robots for placing electronic components.

BACKGROUND OF THE INVENTION

It is known that in order to assemble components quickly on a card, a robot can be used which takes a component from a dispenser film and places it at the appropriate location on a card. The thickness of the film is about 0.1 mm. The present invention relates to the film after the components have been taken from it. It is necessary to remove the film from the machine, to store it, and finally to discard it.

Traditionally, the film is wound onto the hub of a reel that is rotated. If the reel rotates at constant speed, then the winding speed of the film is irregular and depends on the extent to which the reel has been filled. As a result, the traction which is applied thereto varies, and numerous breaks are observed in such film, thereby requiring the machine to be stopped.

In order to remedy that drawback, proposals have already been made to cause the film to pass between two knurled wheels whose peripheries come into contact, and then to store the film behind the wheels in a suitable compartment. However, the film has a tendency to wind around the knurled wheels. In addition, that fixed system requires a special drive provided by means of a DC motor, and that is very expensive.

OBJECTS AND SUMMARY OF THE INVENTION

An object of the present invention is to mitigate the drawbacks of known systems and to propose a system that is simple, adjustable, and reliable.

According to the invention, the timed device for removing a strip or film, in particular a strip for carrying electronic components and after the components have been removed therefrom, comprises a clamp member driven with-reciprocating motion, synchronized by the machine, and entraining and pushing the film step by step.

In a first embodiment, the device comprises a clamp driven with synchronized reciprocating motion entraining the film into a storage cavity.

In another embodiment of the invention, the device comprises two synchronized one-way toothed wheels entraining the film step by step. The term "one-way wheel" is used to designate a wheel of the "freewheel", type which can rotate in one direction only.

Thus, by back-and-forth motion of a wheel, the device pushes the plastics film towards its storage location, with the applied force remaining constant over the entire length of the film so operation is safe. The pay-out step size of the strip in this type of machine lies in practice in the range 4 mm to 12 mm. This device enables the film to be advanced by a determined length synchronously with the general movement of the robot.

BRIEF DESCRIPTION OF THE DRAWINGS

Other characteristics and advantages of the invention will appear on reading the following description of two particular embodiments, given purely as non-limiting examples, and with reference to the accompanying figures, in which.

MORE DETAILED DESCRIPTION

Figure 1:
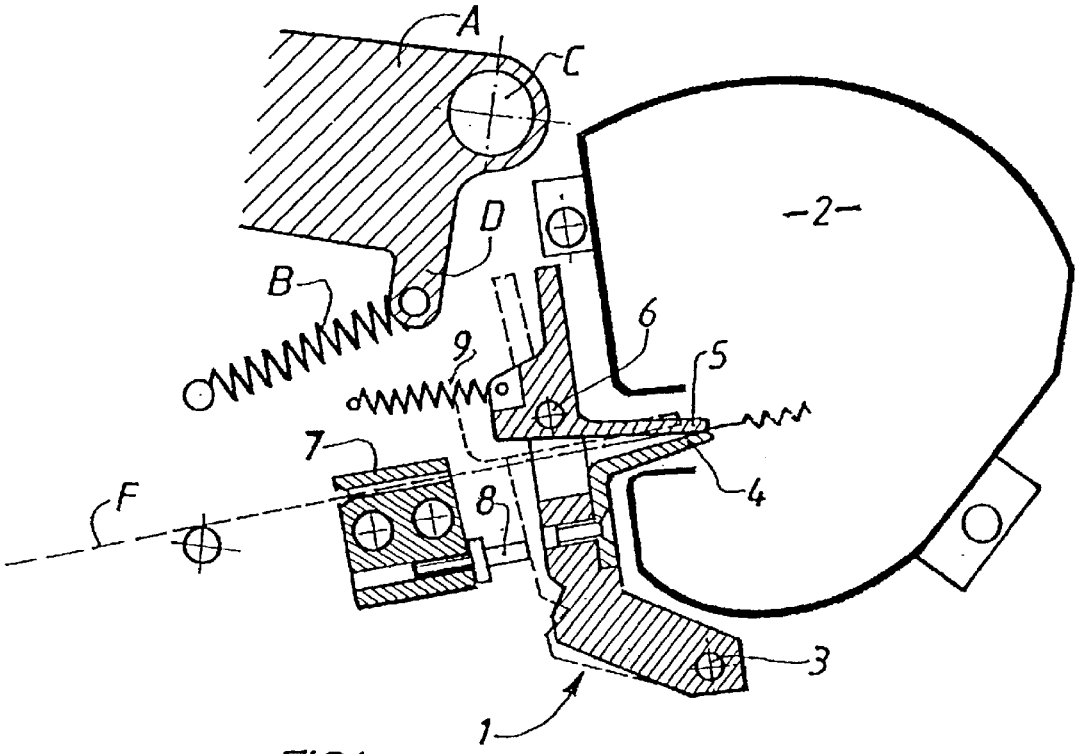
FIG. 1 is a diagram of a first embodiment.

In the top left portion of FIG. 1, there can be seen a part A that already exists on the machine and that is biased by a spring B. This part pivots on a pin C. In conventional machines, this part is designed to cause the film to advance so as to enable it to be wound on a hub, and it is used in the invention to close and advance the clamp given overall reference 1 in the figure. The film is evacuated into a recovery and storage cavity 2 that is removably fixed to the machine (not shown). The purpose of the clamp is to take hold of the film F and to push it into the cavity 2 by a step by step movement.

The clamp 1 is mounted to pivot about a pin 3. Its angular movement about the pin 3 enables the film to be advanced by a determined length in synchronism with the general movement of the robot. The clamp 1 has a bottom jaw 4 which is fixed on the clamp and a top jaw 5 which is movable relative to the jaw 4, about a pin 6 which is fixed to the clamp 1. This relative movement results from the part A bearing against the top portion of the jaw 5. This pressure causes the two jaws to move towards each other and consequently causes the film F to be taken hold of and moved together with the clamp. The film is released when the top jaw 5 takes up the position shown in dashed lines in the figure. This position is the result of the pressure exerted by the part A being released and the action of a return spring 9 fixed at one of its ends to the machine and at its other end to the flange of the jaw 5. That is to say the clamp 1 opens or closes under the action of the part A, with the position shown in continuous lines in the figure being the closed position of the clamp. In this position, the clamp 1 compacts the film which is crumpled up so as to take up less room in the storage area 2.

A guide 7 for the film F is preferably provided at the inlet to the clamp and fixed to the structure of the machine. In accordance with a characteristic of the invention, the guide has an adjustable stop 8 for limiting the rearward movement of the clamp when it is in the position shown in dashed lines in the figure. In this position, the film F is held between the jaws 4 and 5, with the flange of the jaw 5 coming into contact with the projection D of the part A so as to close the clamp 1 when the clamp is in its rearmost position. After closing it in this way, the projection D moves the entire clamp to the right in the figure, thereby entraining the film.

The clamp is thus closed and driven by the part A. When it reaches the position shown in continuous lines in the figure, the part A releases the flange of the clamp 5 which is turned upwards by the spring 9. The film F is released and the clamp 1 pivots rearwards without entraining the film until it returns to the position shown in dashed lines where it is again subjected to closure, with the forward movement of the clamp entraining the film F by a corresponding length. This length can be varied over the range 4 mm to 12 mm and is substantially the length occupied by a component on the film F.

Figure 2:
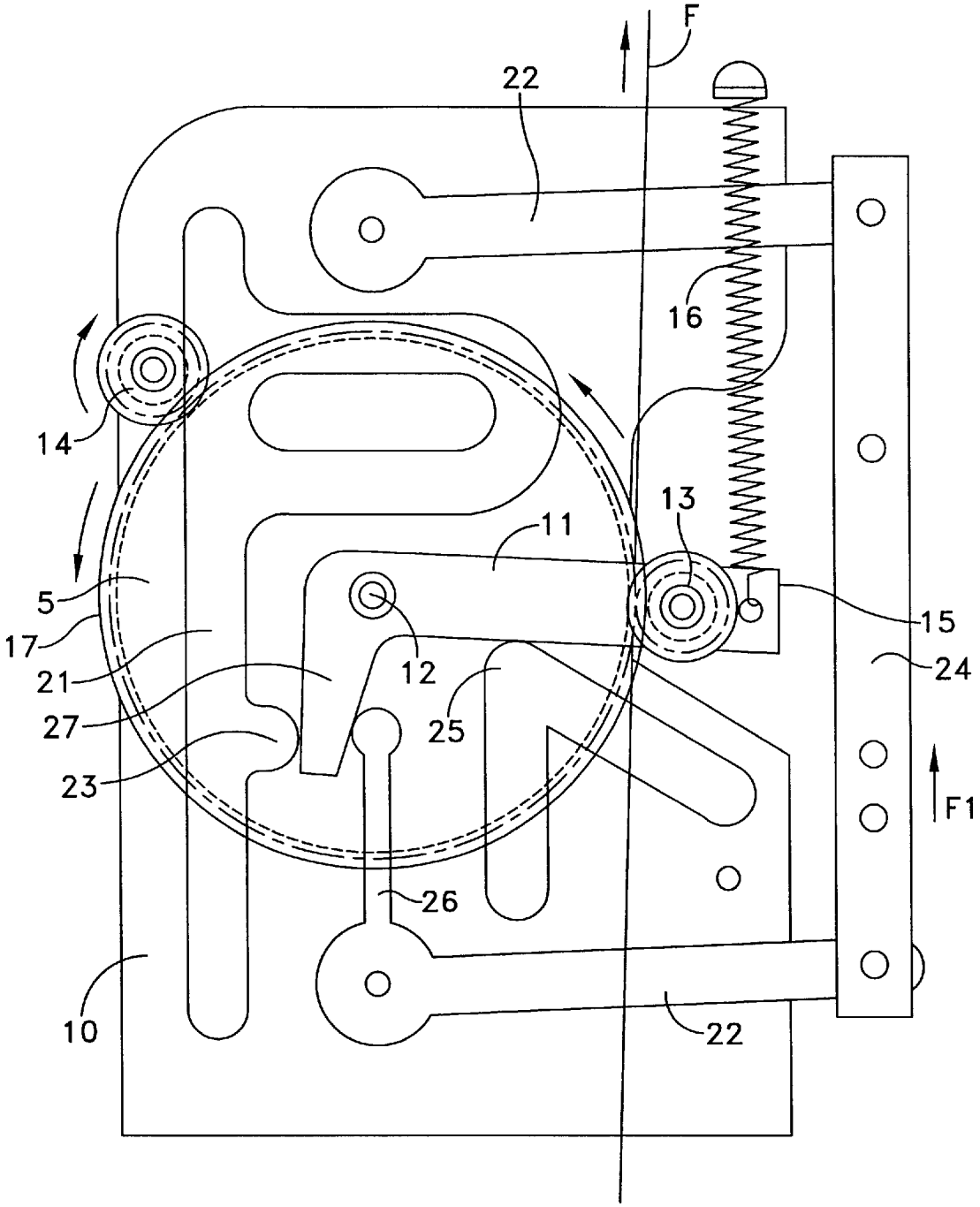
FIG. 2 is a view of the device constituting a second embodiment, shown in a first position.
Figure 3:
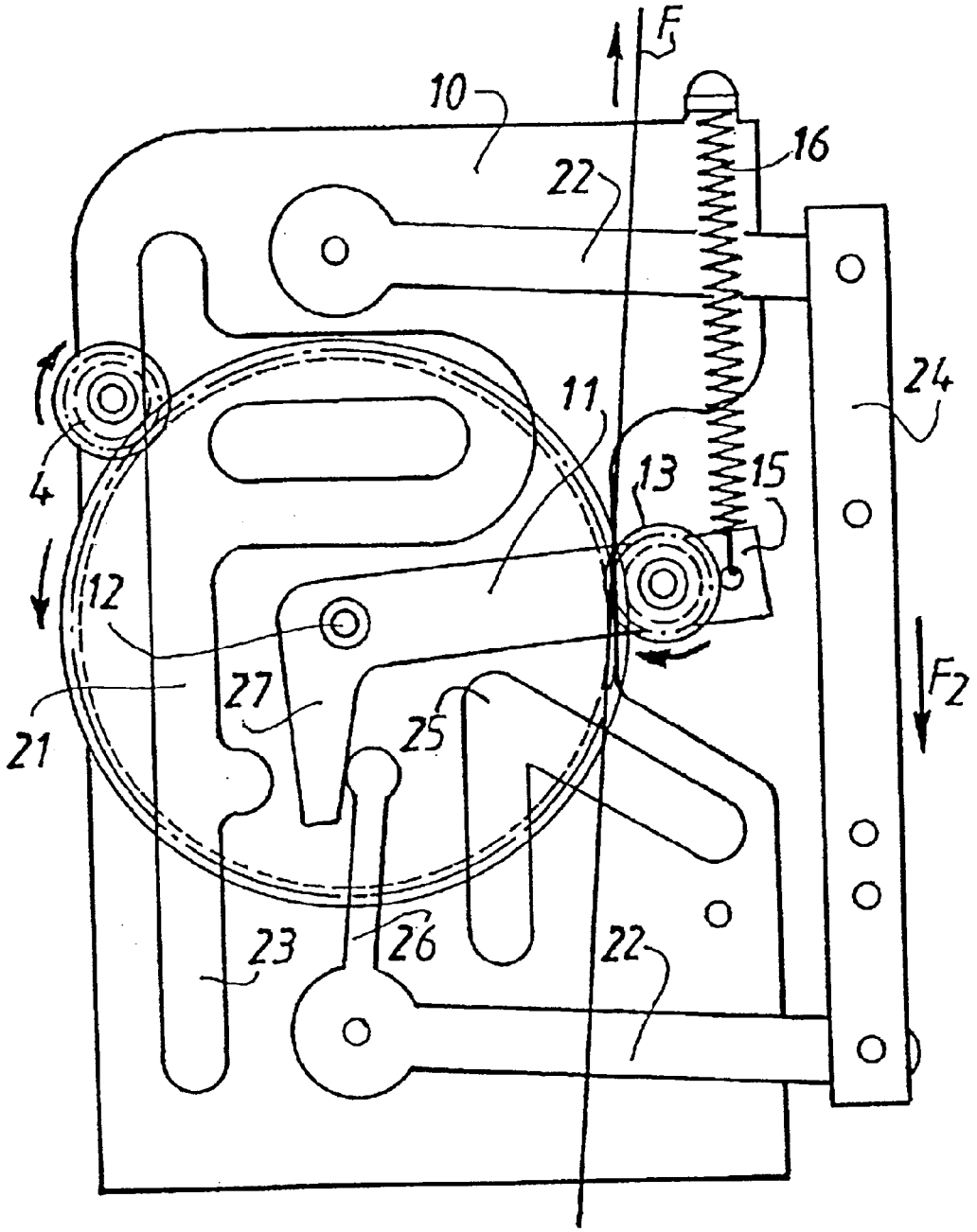
FIG. 3 shows the same device in a second position.

FIGS. 2 and 3 show another embodiment in which the clamp has been replaced by toothed wheels. During each cycle of the machine, the device takes up two positions in succession.

The device comprises a plate 10 having a bell-crank 11 pivoted thereon about a pin 12. The longer limb of the crank has a one-way toothed wheel 13 mounted thereon that is free to rotate in the clockwise direction only. A toothed wheel 17 of larger diameter is mounted to rotate about the pin 12. In the example shown, the toothed wheel 17 can turn in both directions. Nevertheless, it is in contact with a third toothed wheel 14 mounted on the plate 10. The wheel 14 is a one-way wheel and can rotate in the clockwise direction only. Thus, insofar as the wheel 17 is always engaged with the wheel 14, the wheel 17 is free to rotate only in the counterclockwise direction, and is thus caused to be a one-way wheel. The wheel 17 is always in contact with the wheel 13 so the film F is always held. The end 15 of the crank 11 is biased towards the top of the figure by a spring 16 whose other end is secured to the plate 10.

A bar 21 is mounted on the plate 10 and one of its edges constitutes a stop 23. A link 24 is carried on two rods 22 and is driven by the machine (not shown) with reciprocating motion. The pivoting movement of the crank 11 about the pin 12 is thus limited on the left of the figure by the stop 23. Pivoting is also limited by the long side of the crank 11 bearing against a second stop 25 formed on the plate 10.

The film F is continuously clamped between the wheel 13 and the wheel 17 and it is moved in the example shown upwards in the figure. If the direction of rotation of the wheels were to be reversed, then the film would move downwards.

The device operates as follows:

In the position shown in FIG. 2, the link 24 has just been moved by the machine downwards in the figure, thereby tensioning the spring 16 and causing the arm 26 of the bottom rod 22 to pivot counterclockwise. The spring will return the link 24 upwards in the figure as represented by arrow F1. The bottom limb of the crank 11 pivoting in the clockwise direction comes into contact with the stop 23 at the end of its stroke. The end 15 of the crank 11 has been lowered, thereby tensioning the spring 16.

As soon as the force on the link 24 is removed, the spring 16 returns the end 15 of the crank 11 upwards in the figure. Since the wheel 13 is prevented from rotating in the counterclockwise direction, it entrains the wheel 17 through a determined angle which corresponds to the advance step desired for the film. The film F is entrained upwards between the two wheels. The wheel 17 causes the wheel 14 to turn in the clockwise direction through a corresponding angle. Simultaneously, the short limb 27 of the crank 11 is disengaged from the stop 23. This leads to the position shown in FIG. 3 where the spring 16 is relaxed.

Another impulse applied to the link 24 causes the short limb of the crank to pivot counterclockwise entraining the end 15 of the crank downwards. The wheel 13 moves back down over the wheel 17, rotating since it is free to rotate in the clockwise direction. The film is not entrained. However, the wheel 17 i prevented from moving by the wheel 14 and cannot rotate in this direction. It therefore remains stationary. The wheel 13 moves down, rolling over the plastics film, thereby enabling any irregularity of advance that might arise because of mechanical play to be compensated. The downward movement of the wheel 13 is limited by the limb 27 coming into contact with the stop 23. The various members are then back in the positions shown in FIG. 2 and a new cycle can begin. The wheels 13 and 17 can rotate in opposite directions only, and they rotate one after the other.

The film is evacuated into a recovery and storage cavity that is removably fixed to the machine (not shown) after the film has been cut up, with the pieces of film being sucked up by a fan and stored in a waste disposal can. The object of the clamp-forming device is to take hold of the film F and to push it step by step with a step size that is variable over the range 4 mm to 12 mm, i.e. substantially the range of sizes occupied by components on the film F.

Devices of the invention are adjustable and can be adapted over time to different requirements of constructors. They can be fitted to any mechanical system.

What is claimed is:

1. A device for evacuation of a strip carrying components after the components have been removed from the strip by a machine, the device comprising:

a clamp member for driving the strip with a stepping motion, the clamp member being synchronized by a coupling with the machine, and entraining and pushing the film step by step into a storage cavity, wherein the clamp member comprises two toothed wheels that are engaged together, one of the toothed wheels being mounted to rotate on a plate and a second of the toothed wheels being mounted to rotate on a bell-crank that pivots about a pin of said second of the toothed wheels, wherein the strip is clamped at a position along the strip between portions of said toothed wheels for driving the strip, wherein the toothed wheels are each rotatable in one direction only, whereby the position between the toothed wheels is advanced relative to the strip as one of said toothed wheels rotates, and the strip advances as the other of said toothed wheels rotates.

2. A device according to claim 1, wherein one of said toothed wheels has a greater diameter than the other of said toothed wheels, and further comprising a third toothed wheel that engages with said one of the wheels having the greater diameter, the third toothed wheel being rotatable in one direction only and being arranged to rotate together with said one of the wheels having the greater diameter for causing said one of the wheels having the greater diameter to rotate in said one direction only.

3. A device according to claim 1, further comprising a stop positioned to limit pivoting of the bell-crank.

* * * * *